US008052832B2

(12) United States Patent
Tiefel et al.

(10) Patent No.: US 8,052,832 B2
(45) Date of Patent: Nov. 8, 2011

(54) SPLICING ASSEMBLY AND METHOD

(75) Inventors: Rick Lee Tiefel, Clay City, IN (US); Thomas Jay Newsom, Brazil, IN (US)

(73) Assignees: Sony Corporation, Tokyo (JP); Sony DADC US Inc., Terre Haute, IN (US)

( * ) Notice: Subject to any disclaimer, the term of this patent is extended or adjusted under 35 U.S.C. 154(b) by 1096 days.

(21) Appl. No.: 11/375,840

(22) Filed: Mar. 14, 2006

(65) Prior Publication Data

US 2006/0272763 A1 Dec. 7, 2006

Related U.S. Application Data

(60) Provisional application No. 60/688,627, filed on Jun. 7, 2005.

(51) Int. Cl.
*B65H 21/00* (2006.01)

(52) U.S. Cl. ..... 156/304.3; 156/304.1; 156/502

(58) Field of Classification Search ..... 156/304.1, 156/304.3, 502
See application file for complete search history.

(56) References Cited

U.S. PATENT DOCUMENTS

| | | | | | |
|---|---|---|---|---|---|
| 1,781,200 | A * | 11/1930 | Spiros | ..... | 156/379 |
| 2,252,685 | A * | 8/1941 | Babcock | ..... | 156/502 |
| 3,053,711 | A * | 9/1962 | Eagle et al. | ..... | 156/502 |
| 3,142,607 | A * | 7/1964 | Scherer | ..... | 156/506 |
| 3,546,046 | A * | 12/1970 | Macqueston | ..... | 156/505 |
| 3,699,832 | A * | 10/1972 | Smith et al. | ..... | 83/210 |
| 3,957,567 | A | 5/1976 | Pursell et al. | | |
| 4,314,437 | A | 2/1982 | Rohner et al. | | |
| 5,078,828 | A * | 1/1992 | Marglin | ..... | 156/505 |
| 5,314,568 | A | 5/1994 | Ryan | | |
| 5,779,851 | A * | 7/1998 | Ifkovits et al. | ..... | 156/505 |
| 6,227,731 | B1 | 5/2001 | Kralles et al. | | |
| 6,792,987 | B2 * | 9/2004 | Monroe | ..... | 156/351 |
| 6,880,604 | B2 * | 4/2005 | Keene | ..... | 156/504 |
| 2002/0189764 | A1 * | 12/2002 | Keene et al. | ..... | 156/353 |

* cited by examiner

*Primary Examiner* — Mark A Osele
(74) *Attorney, Agent, or Firm* — Trellis IP Law Group, PC

(57) ABSTRACT

A splicing assembly comprising a splicing plate having a structure defining at least two cutting grooves. A positioning marker is disposed on the splicing plate, and at least one clamping assembly is coupled to the splicing plate. A method for installing a roll of labels on a labeler comprising removing from the labeler a first core which supports a sheet having labels. The sheet is positioned on a support surface. A second core, which supports a sheet having labels, is positioned on the labeler. The sheet from the second core is disposed on top of the sheet from the first core after the latter has been disposed on a support surface. The sheets are subsequently cut and spliced. A method for splicing comprising cutting a pair of superimposed pliable substrates to produce a pair of residual pliable substrates which are subsequently spliced.

15 Claims, 19 Drawing Sheets

SPLICING ASSEMBLY AND METHOD

CROSS REFERENCE TO RELATED APPLICATIONS

This patent application is related to Provisional Patent Application having application No. 60/688,627, filed Jun. 7, 2005, and fully incorporated herein by reference thereto as if repeated verbatim immediately herein. Benefit of the Jun. 7, 2005 filing date for the Provisional Patent Application is claimed.

FIELD OF THE INVENTION

Embodiments of the present invention are related to a splicing assembly and method. More specifically, embodiments of the present invention provide a splicing plate assembly and method for splicing pliable substrates, such as sheets supporting labels.

BACKGROUND OF THE INVENTION

Conventional labeling machines produced by manufacturers are capable of automatic splicing rolls of labels on the fly. These machines are roll-up units that use a dual unwind system to feed a sheet of remaining labels from an exhausted roll of labels into a bin to produce a sheet of buffer labels. A new roll of labels is spliced onto the sheet of buffer labels. These machines are large and costly.

Operators of other conventional labeling machines typically use an extended length of time to replace an exhausted roll of labels with a new roll of labels. Because of the complexity involved in threading a sheet of labels, many operators of these conventional machines often improperly thread sheets of labels, causing a long downtime. Some operators require frequent retraining in order to readily possess the ability properly change rolls of labels.

What is needed and what has been invented is a splicing assembly that reduces the length of time for changing a roll of labels, the downtime created by the improper threading of sheets of labels, and the amount of time that is spent training operators to thread labelers.

SUMMARY OF EMBODIMENTS OF THE INVENTION

Embodiments of the present invention provide a method for installing a roll of labels on a labeler. The method comprises removing from a labeler a core (e.g., a generally exhausted core) that supports a sheet which has a plurality of labels. The sheet is disposed on a support surface. A replacement or new core is then positioned on the labeler. The replacement core supports a sheet which has a plurality of labels. The sheet from the replacement core is disposed on top of the sheet from the removed core, and the two sheets are then cut (e.g., between a respective pair of spaced labels on each sheet) and subsequently coupled or spliced together. The method may additional comprise aligning one of the labels from the removed core with a label-positioning indicia on the support surface. The label-positioning indicia may generally have the same configuration as, or different color from, a label from the removed core. The cutting of the two sheets comprises passing a knife member through a groove in the support surface. The coupling or splicing of the two sheets together may include superimposing a coupling medium on a portion or section of the sheet from the removed core and the sheet from the replacement core. The coupling medium is subsequently cut after being disposed on a section of the two sheets, such as by passing the knife member through a groove in the support surface.

Embodiments of the present invention also provide a method for a method for splicing a pair of pliable substrates. Each of the pliable substrates supports a plurality of members (e.g., labels, banners, signs, etc), preferably spaced members. The method includes superimposedly disposing one pliable substrate on the other pliable substrate, and severing the pliable substrates. Severing of the substrates is preferably between a respective pair of spaced members on each respective pliable substrate, and produces a residual pliable substrate and a severed pliable substrate for each respective pliable substrate. The severed pliable substrate of one pliable substrate is removed to expose the residual pliable substrate of the other pliable substrate which may then be spliced to the residual pliable substrate of the former pliable substrate. Splicing of the two residual pliable substrates comprises disposing a splicing tape on a section of the two residual pliable substrates. The splicing tape may subsequently be cut at least once in a cutting direction which is generally normal to the cutting direction in which the pliable substrates were severed.

Embodiments of the present invention further also provide a splicing assembly comprising a splicing plate having a structure defining at least one cutting groove. A positioning marker is disposed on the splicing plate, and at least one clamping assembly is coupled to the splicing plate. The splicing assembly may additionally comprise a labeler assembly (or any other assembly) coupled to the splicing assembly.

These provisions, together with the various ancillary provisions and features which will become apparent to those skilled in the art as the following description proceeds, are attained by the methods and assemblies of the present invention.

DETAILED DESCRIPTION OF THE EMBODIMENTS OF THE INVENTION

Figure 1:
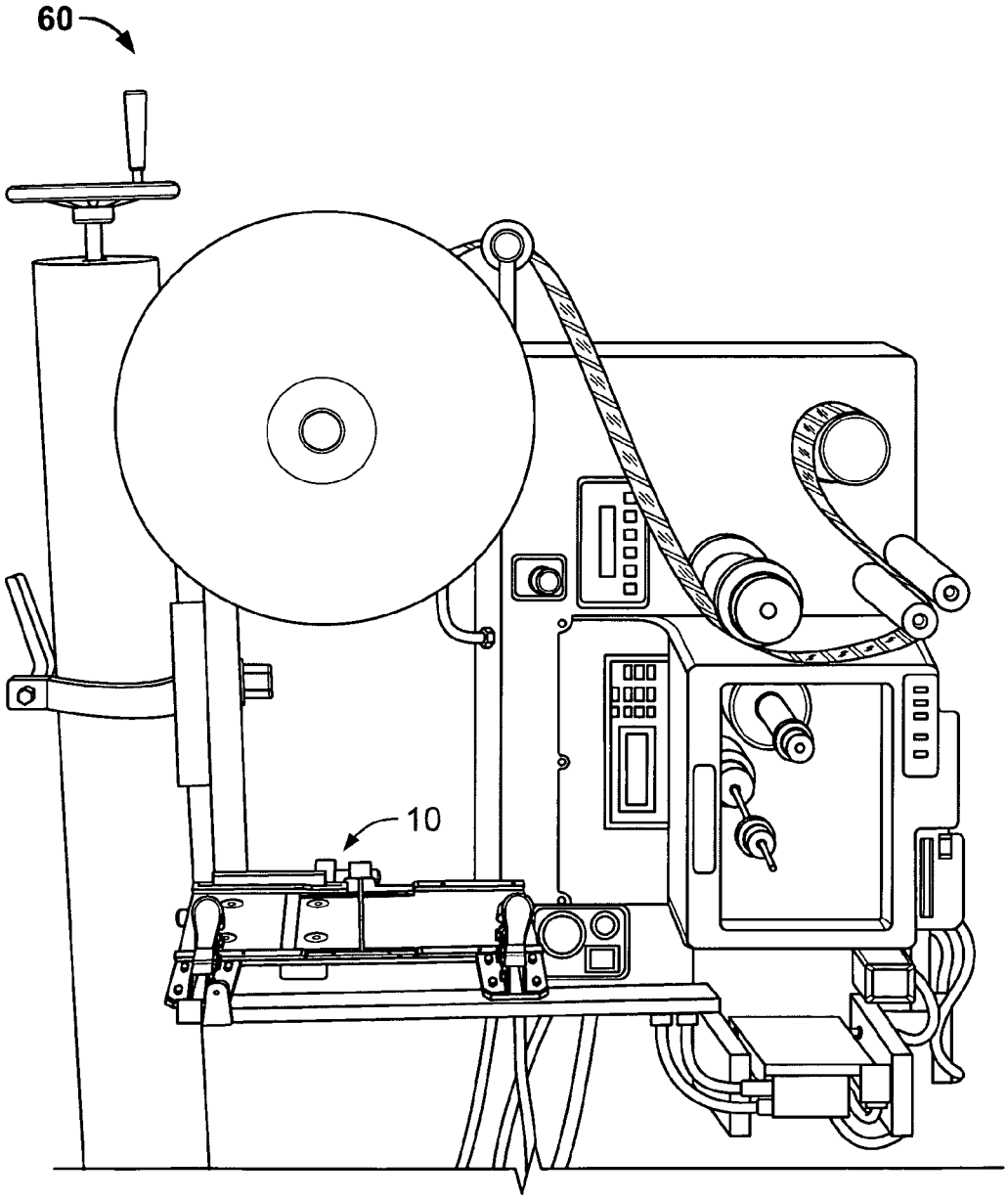
FIG. 1 is a front elevational view of a labeler having an embodiment of the splicing plate assembly secured thereto.

In the description herein, numerous specific details are provided, such as examples of components and/or methods, to provide a thorough understanding of the embodiments of the present invention. One skilled in the relevant art will recognize, however, that an embodiment of the invention may be practiced without one or more of the specific details, or with other apparatus, systems, assemblies, methods, components, materials, parts, and/or the like. In other instances, well-known structures, materials, or operations are not specifically shown or described in detail to avoid obscuring aspects of the embodiments of the present invention.

Referring in detail now to the drawings, there is seen in FIGS. 1-5 a splice plate assembly, generally illustrated as 10. The splice plate assembly 10 has a splice plate 14, a label positioning marker 16, and a plurality of opposed sheet guides, respectively generally illustrated as 18 and 22. Sheet guides 18 and 22 connect to opposed sides of the splice plate 14 and are transversely spaced at a distance which is generally equal to the width of a sheet or pliable substrate that is disposed on the splice plate 14. Guides 18 and 22 respectively include spaced guides 18*a*, 18*b* and 22*a*, 22*b*. Guide 22*a* is formed with a slot 70 for storing a knife 80 which is employed for cutting sheets of any suitable material and for cutting splicing tape, identified as "50" hereafter.

The splice plate assembly 10 also includes a plurality of opposed tape guides, respectively generally illustrated as 23 and 25. Tape guides 23 and 25 connect to opposed sides of the splice plate 14 and are transversely spaced at a distance which is generally equal to the width of a sheet or pliable substrate that is disposed on the splice plate 14. Tape guides 23 and 25 respectively include spaced tape guides 23*a*, 23*b* and 25*a*, 25*b*. Guide 25*a* includes a portion of slot 70. Tape guides 23*a*, 23*b* and 25*a*, 25*b* are respectively longitudinally spaced at a distance which is generally equal to the width of the splicing tape, identified as "50" below. After the splicing tape has been placed across severed sheets, and between tape guides 23*a*, 23*b* and 25*a*, 25*b*, the splicing tape is cut twice, all as explained more particularly hereafter.

Figure 2:
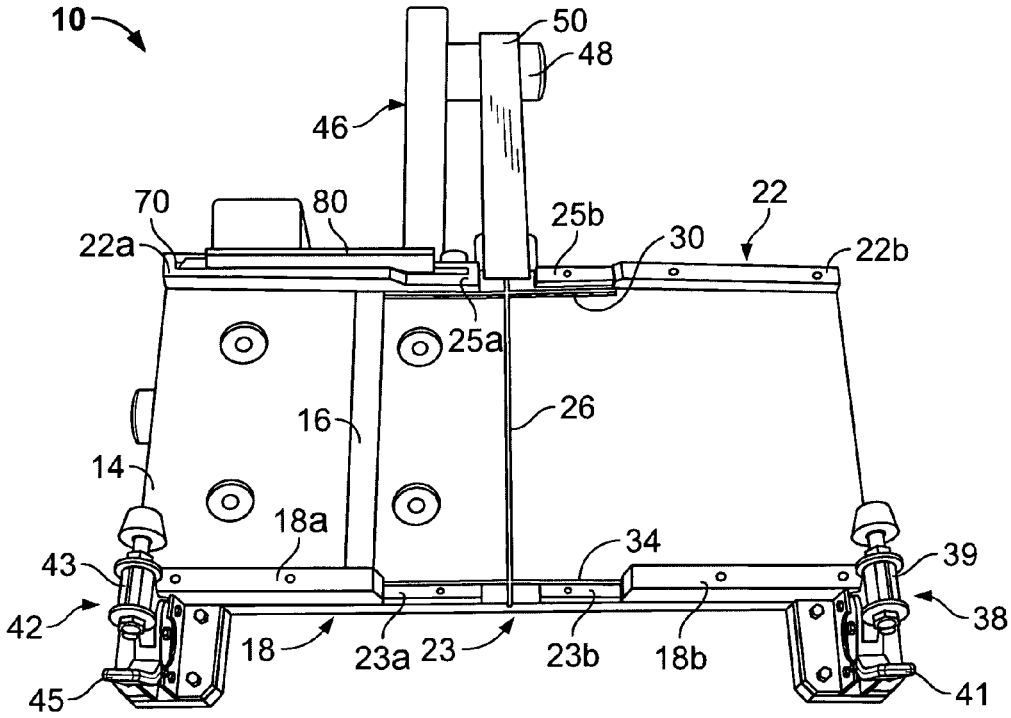
FIG. 2 is a perspective view of an embodiment of the splicing plate assembly.
Figure 3:
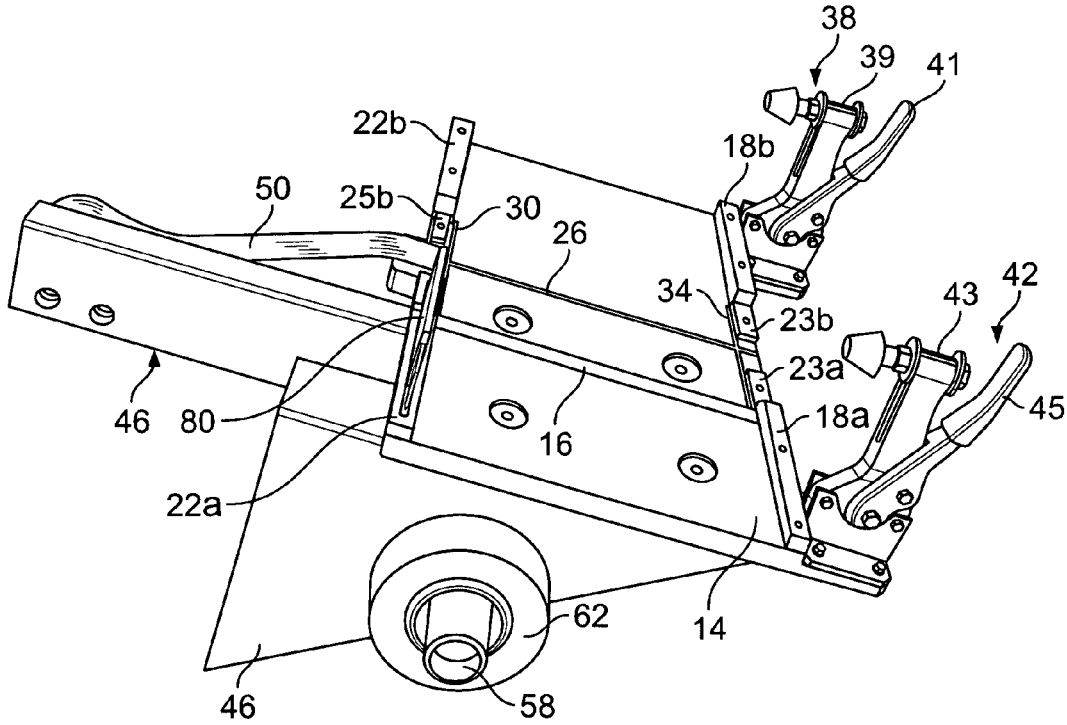
FIG. 3 is another perspective view of the embodiment of the splicing plate assembly in FIG. 2.
Figure 4:
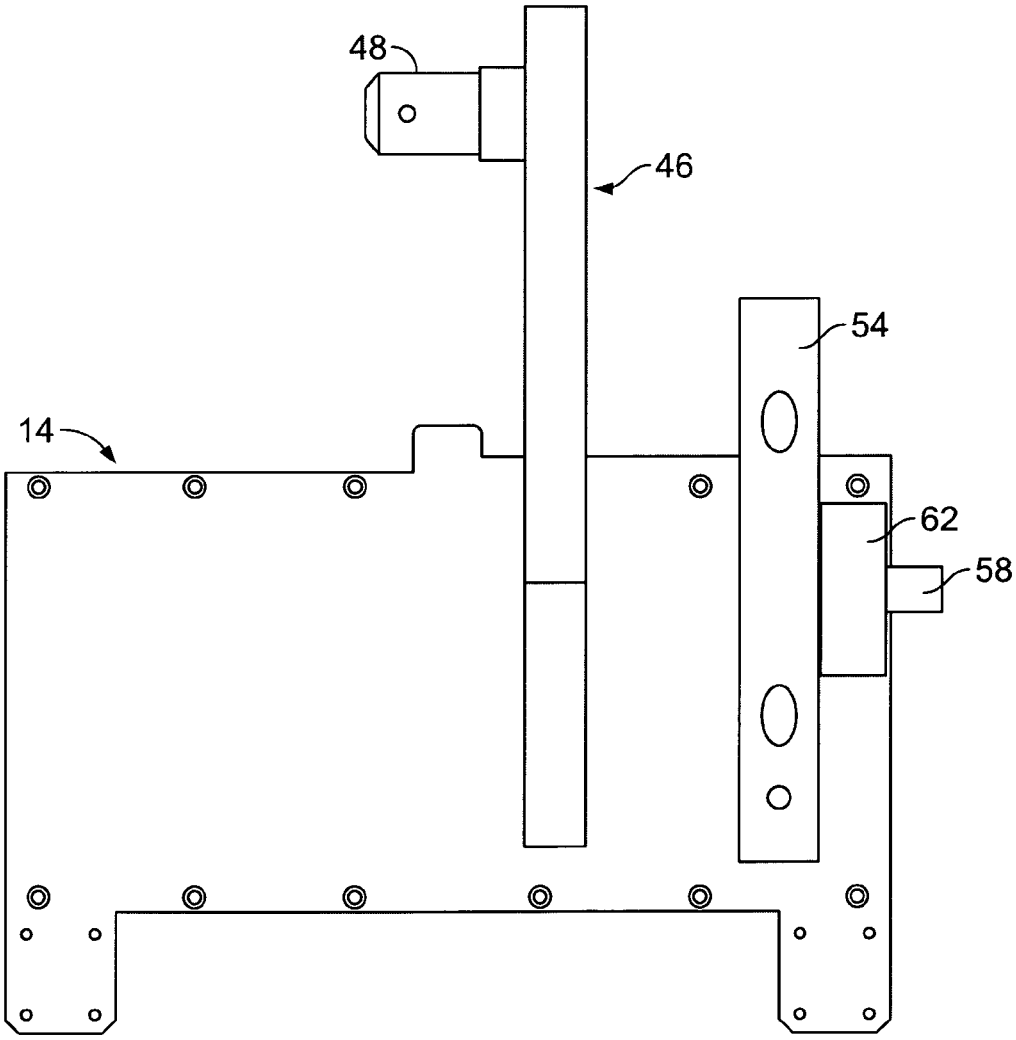
FIG. 4 is a bottom plan view of the embodiment of the splicing plate assembly in FIG. 2.
Figure 5:
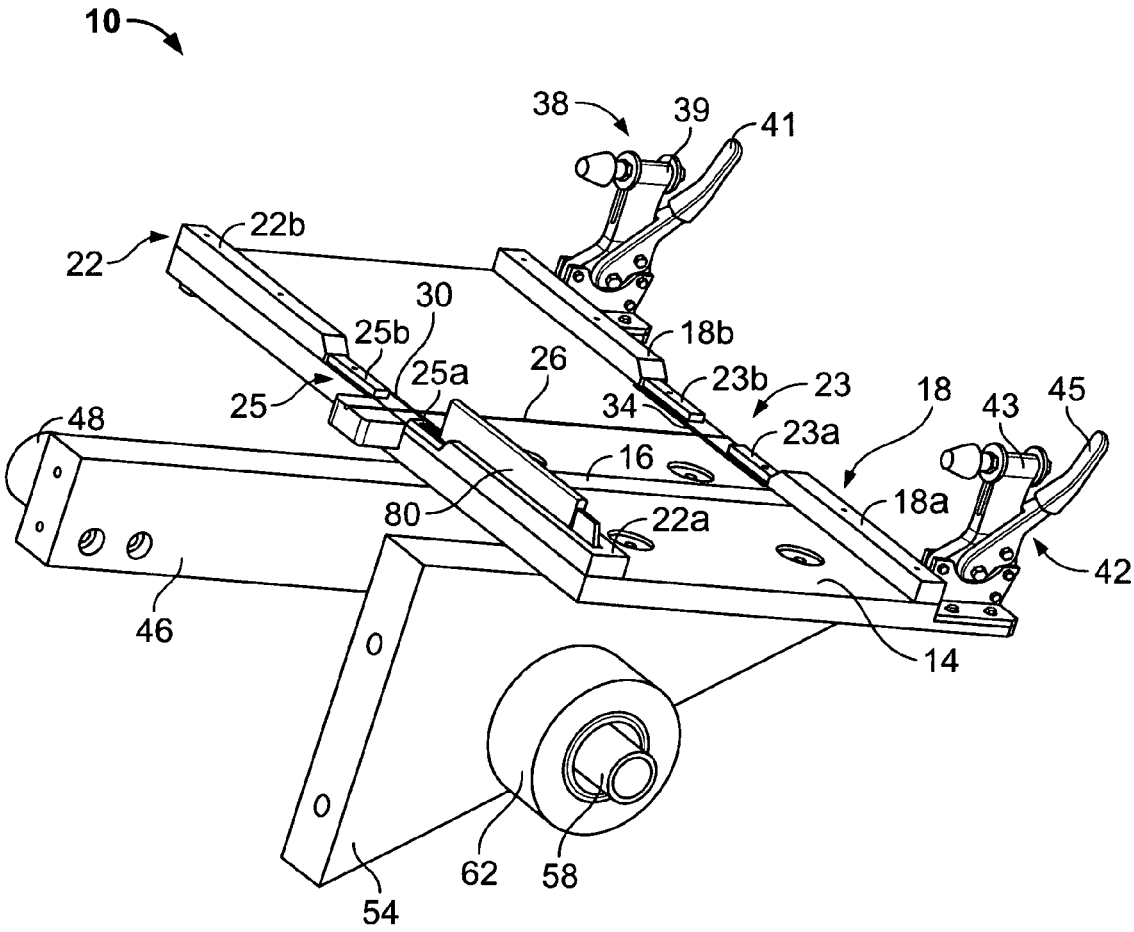
FIG. 5 is yet another perspective view of the embodiment of the splicing plate assembly in FIG. 2.

Between spaced sheet guides 18*a*, 18*b*, 22*a*, 22*b*, and between spaced tape guides 23*a*, 23*b* and 25*a*, 25*b*, and transversely extending across splice plate 14 is a cutting groove 26. When superimposed sheets are disposed on the splice plate 14, the sheets may be cut or severed by inserting the knife 80 into an end of cutting groove 26 and subsequently transversely moving the knife 80 across the splice plate 14 and through the sheets while remaining in the cutting groove 26. Longitudinally extending across splice plate 14 is a pair of opposed cutting grooves 30 and 34 which are respectively in proximity to the tape guides 25*a*, 25*b* and 23*a*, 23*b* as best shown in FIGS. 2 and 3. Cutting grooves 30 and 34 are generally normal or perpendicular to cutting groove 26 and are spaced apart at a distance which generally equals the width of a sheet or pliable substrate that is disposed on the splice plate 14 for cutting, so that after the splicing tape has been placed between tape guides 23*a*, 23*b* and 25*a*, 25*b*, and across and over edges of a pair of sheets or pliable substrates, and is subsequently cut, the cut edges of the splicing tape generally registers with the opposed sides of the sheets or pliable substrates being spliced. The splicing tape is cut similarly to the manner that sheets are cut while resting on the splice plate 14. More specifically, after the splicing tape has been placed over edges of a pair of sheets for splicing together, one end of the splicing tape may be cut or severed by inserting the knife 80 into cutting groove 30 and subsequently moving the knife 80 through the splicing tape transversely while remaining in the cutting groove 30. The other end of the splicing tape is similarly cut; that is, knife 80 is inserted into cutting groove 34 and subsequently moved through the splicing tape transversely while remaining in the cutting groove 34.

The splice plate assembly 10 also includes a pair of clamping assemblies 38 and 42. Clamp assembly 38 includes a clamping section 39 and a locking handle 41. After the clamping section 39 has been positioned on the sheet to be clamped against the splice plate 14, locking handle 41 is pivoted downwardly to lock the clamping section 39 into a posture which generally immobilizes a sheet against the top surface of splice plate 14. Similarly, clamp assembly 42 includes a clamping section 43 and a locking handle 45. After the clamping section 43 has been positioned on a sheet to be clamped against a sheet which has already been placed on the splice plate 14, locking handle 45 is pivoted downwardly to lock the clamping section 43 into a posture which generally immobilizes a sheet against the top surface of a sheet which has already been placed on the splice plate 14.

The splice plate assembly 10 further includes a tape-dispenser bracket 46 having a tape holder 48 for holding a roll of splicing tape 50. The tape-dispenser bracket 46 is secured to the splice plate 14 such that when the roll of splicing tape 50 is positioned on tape holder 48, the extended portion of the splicing tape 50 is generally aligned with the cutting groove 26, as best shown in FIG. 2. Such alignment enables the splicing tape 50, when pulled towards the user or operator, to automatically overlap a portion of cut edges of a pair of sheets for splicing purposes, since the cutting action of the knife 80 through the sheets was performed by the knife 80 slidably moving through the cutting groove 26.

The splice plate assembly 10 also further includes a mounting bracket 54 for mounting the splice plate 14 to any suitable machinery assembly, such as the labeler in FIG. 1, generally illustrated as 60. Attached to the mounting bracket 54 is a spare tape holder 58 for holding a spare roll 62 of splicing tape. The labeler 60 has a web sensor (not shown) for stopping when a certain amount of labels are left on a core. The labeler 60 also has a shaft 99 for rotatably supporting a core with a sheet of labels.

Figure 6:
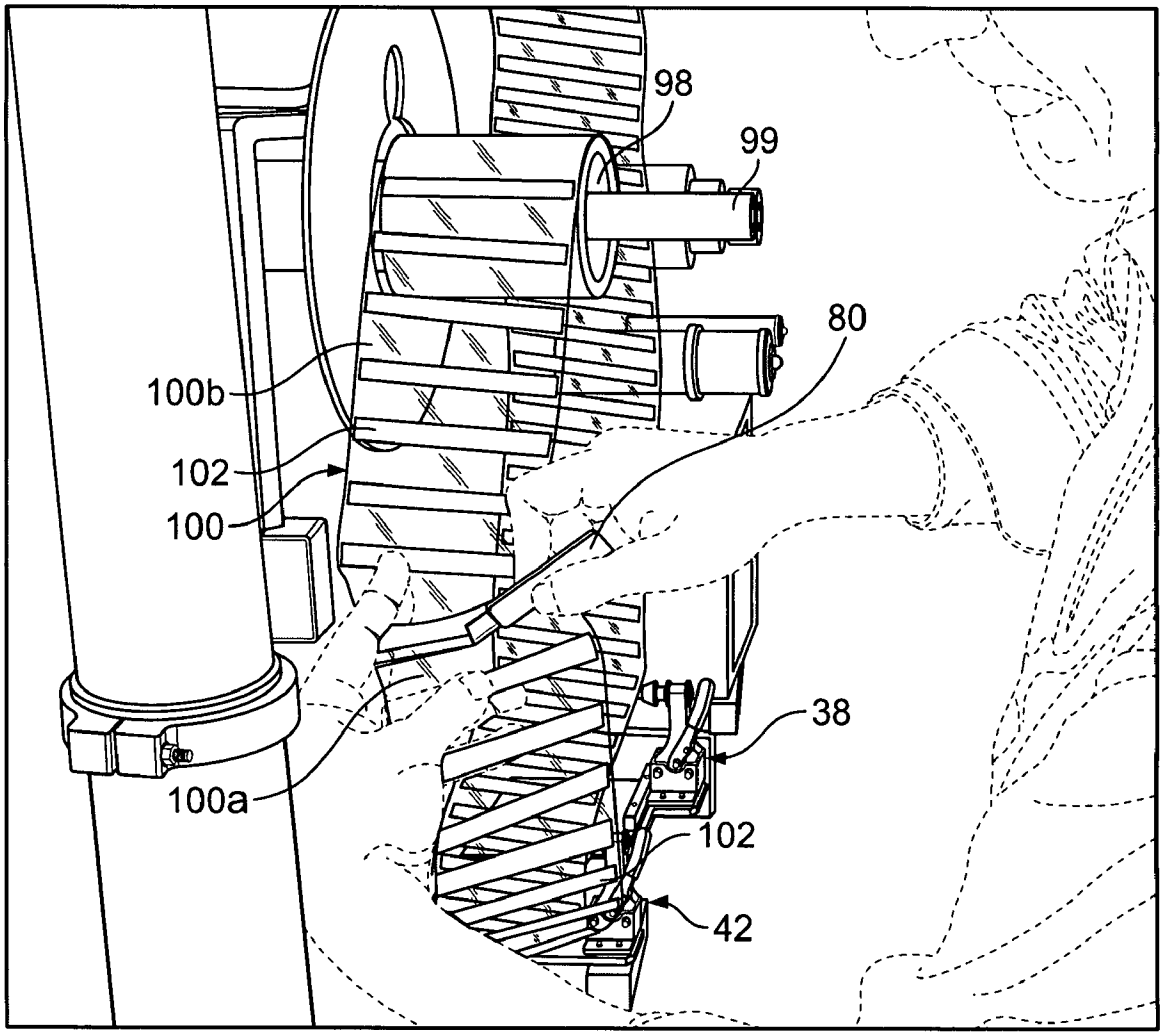
FIG. 6 is a perspective view of a sheet of labels from a generally depleted core being cut so the cut sheet is available to be placed on the splicing plate assembly.

Referring now to FIGS. 6-20 for operation of embodiments of the invention, there is seen in FIG. 6 the labeler 60 having the shaft 99 rotatably supporting a core 98 having a sheet 100 which includes labels 102 that are conveniently spaced apart at a desired distance. With the assistance of the web sensor, the shaft 99 of the labeler 60 will automatically stop before the core 98 becomes completely exhausted of the sheet 100 supporting labels 102. The end of the web sensor adjustment determines the amount of labels 102 left of the sheet 100 before the shaft 99, which supports the core 98, stops rotating. After the shaft 99 stops rotating, a generous desired length of the sheet 100, generally identified as sheet 100*a*, is pulled out or extended from the remaining sheet 100, generally identified as sheet 100*b*, that is left on the core 98. Subsequently, the sheet 100*a* is cut between any pair of spaced labels 102 to separate sheet 100*a* from sheet 100*b*.

Figure 7:
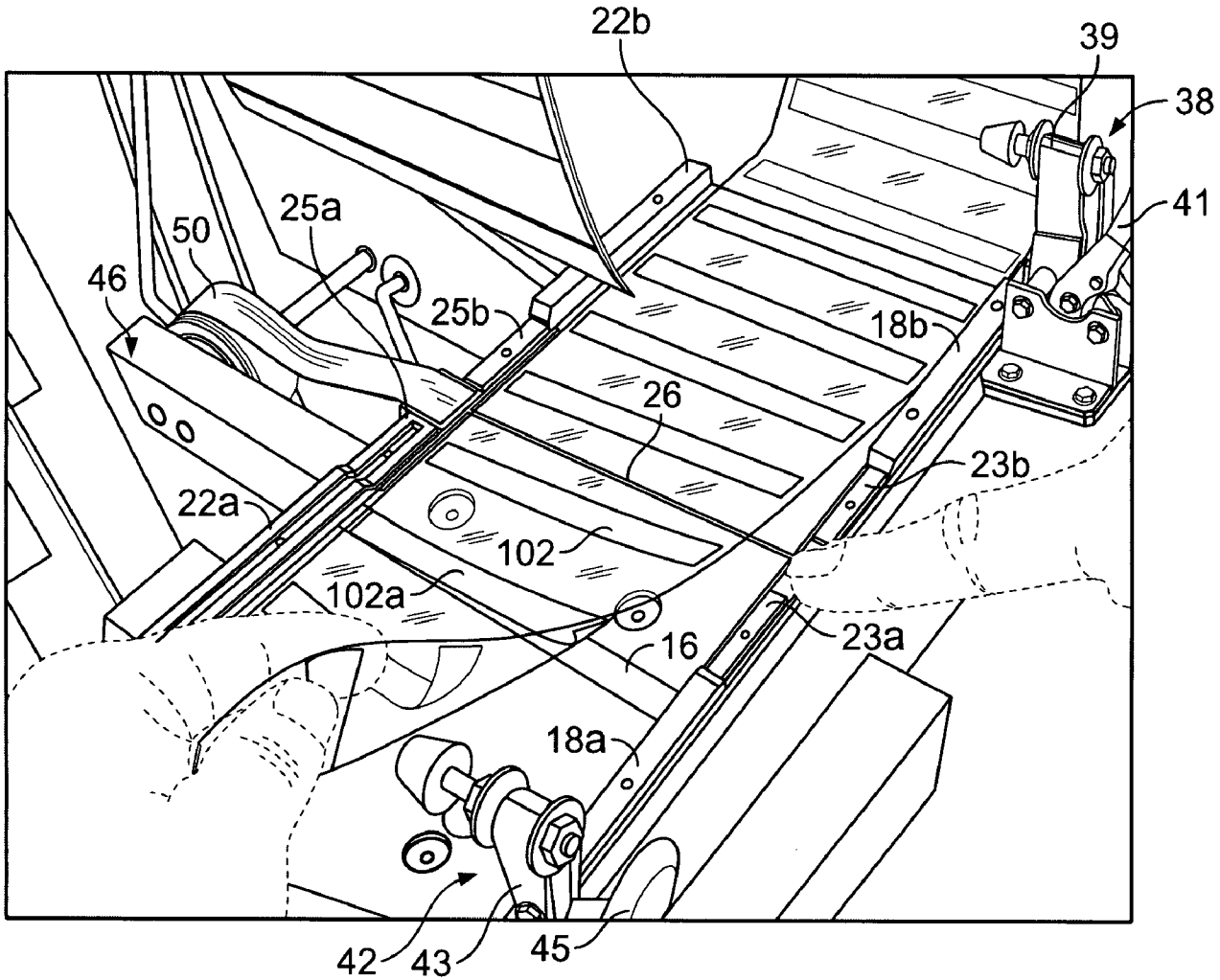
FIG. 7 is a perspective view of a label from the cut sheet from the depleted core being aligned with a label-positioning marker on the splice plate.

After cutting sheet 100 to separate sheet 100 into sheets 100*a* and 100*b*, core 98 is removed from shaft 99 and discarded. Sheet 100*a* is subsequently disposed on splice plate 14 such that one of the labels 102, identified as label 102*a* in FIG. 7, is aligned with the label positioning mark 16 of the splice plate 14. Aligning label 102*a* with the label positioning mark 16 insures that the cutting groove 26 is under the sheet of material between a pair of labels 102-102, and not under any label 102. This insures that a good, strong splice results. The label positioning mark 16 may be any suitable marker. In an embodiment of the invention, label positioning mark 16 generally has the same configuration as the labels 102 (i.e., label 102*a*) to facilitate the alignment of one of the labels 102 (i.e., label 102*a*) with the label positioning mark 16. The labels 102 (including label 102*a*) may generally have the same surface area as the label positioning mark 16. To also facilitate alignment, the labels 102 (including label 102*a*) may have a different color than the label positioning mark 16. For example, the label positioning mark 16 may have a red color since labels 102 (including label 102*a*) typically has a white color.

Figure 8:
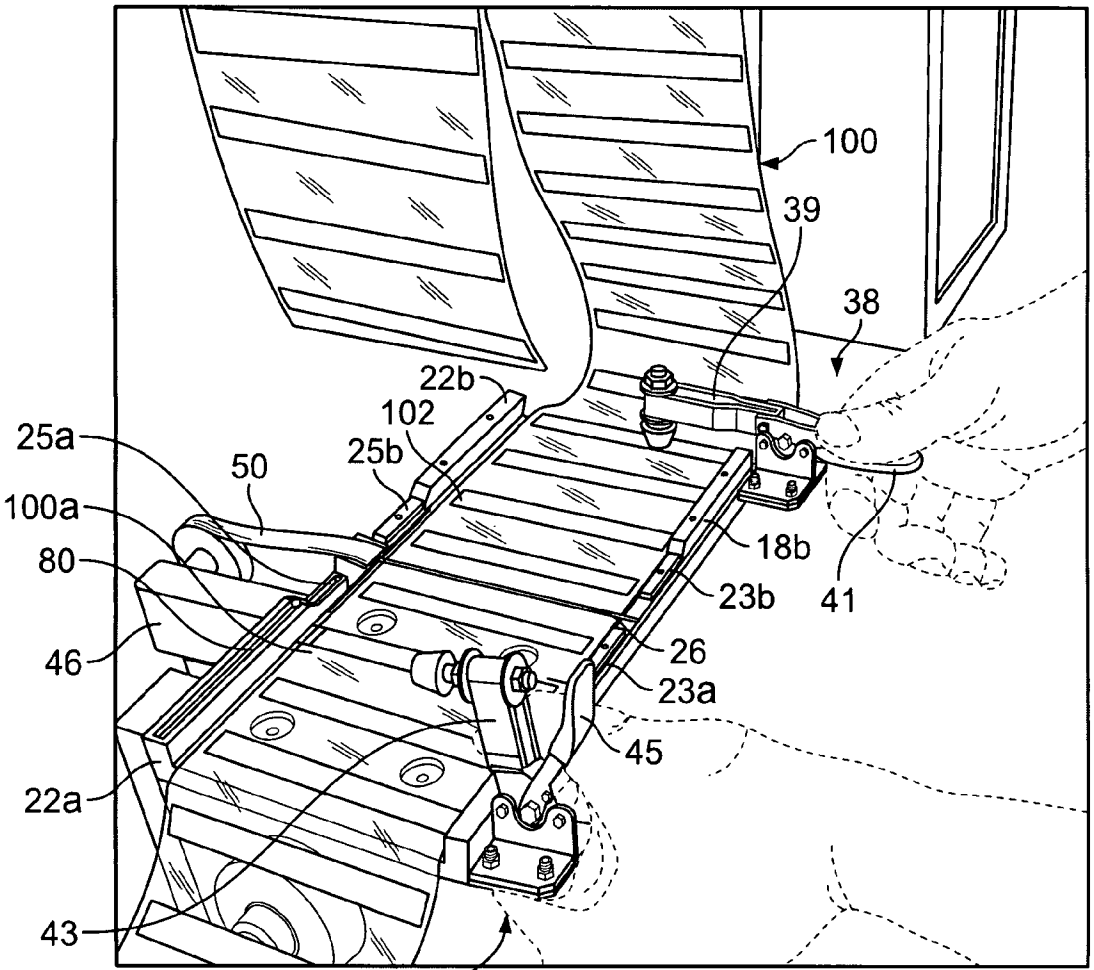
FIG. 8 is a perspective view after the label from the cut sheet from the depleted core has been aligned with the label-positioning marker on the splice plate and after the cut sheet has been clamped.

After sheet 100*a* has been disposed on splice plate 14 such that label 102*a* is aligned with the label positioning mark 16 (as best shown in FIG. 8), clamp assembly 38 is used to generally immobilize sheet 100*a* against the top surface of the splice plate 14. Immobilizing or affixing the sheet 100*a* against the top surface of the splice plate 14 may be accomplished by lowering the clamping section 39 into contact with sheet 100*a*, and then pivoting downwardly the locking handle 41, as best shown in FIG. 8, to lock the clamping section 39 into a posture which generally immobilizes sheet 100*a* against the top surface of splice plate 14.

Figure 9:
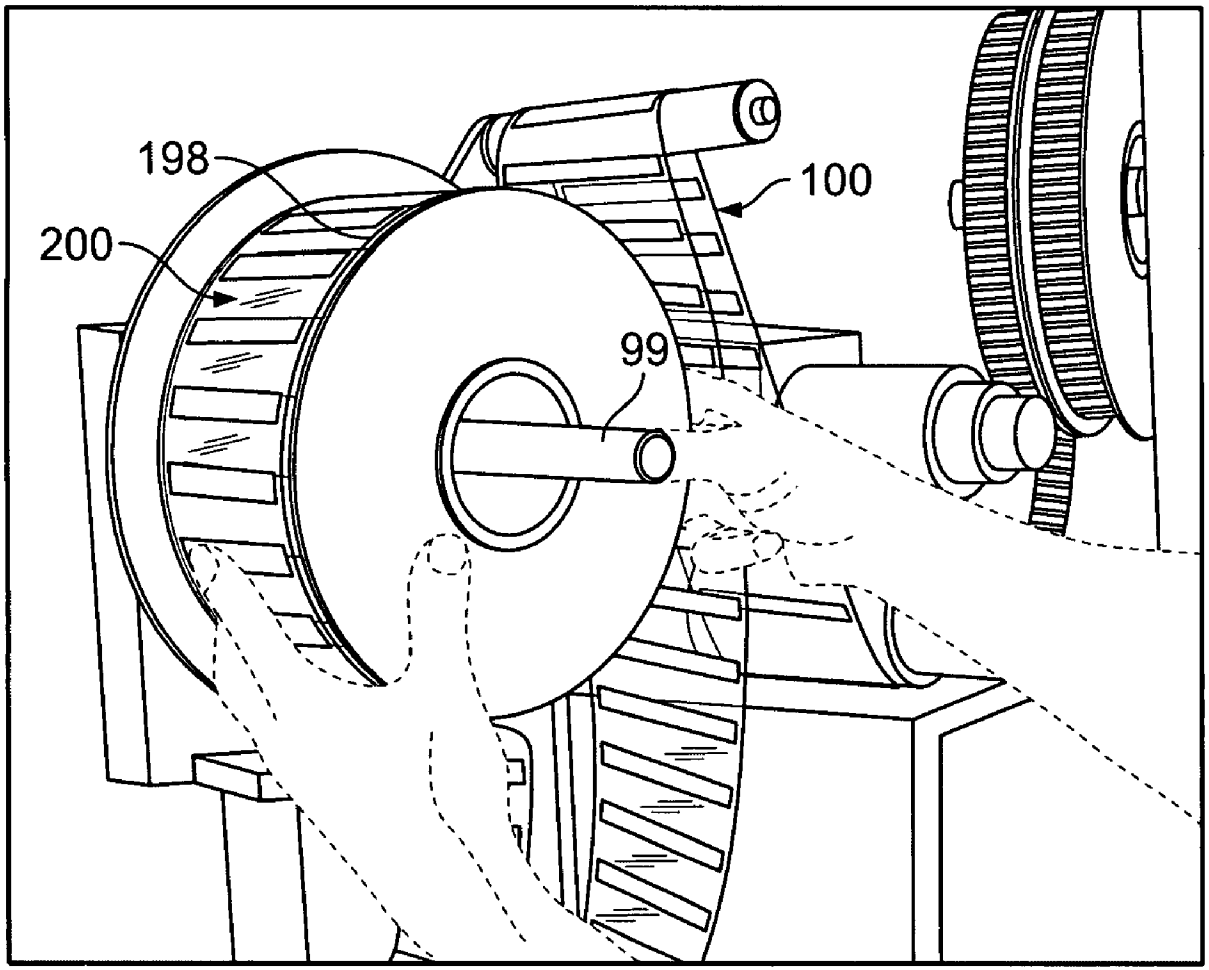
FIG. 9 is a perspective view of a replacement core of labels being mounted on the labeler.
Figure 10:
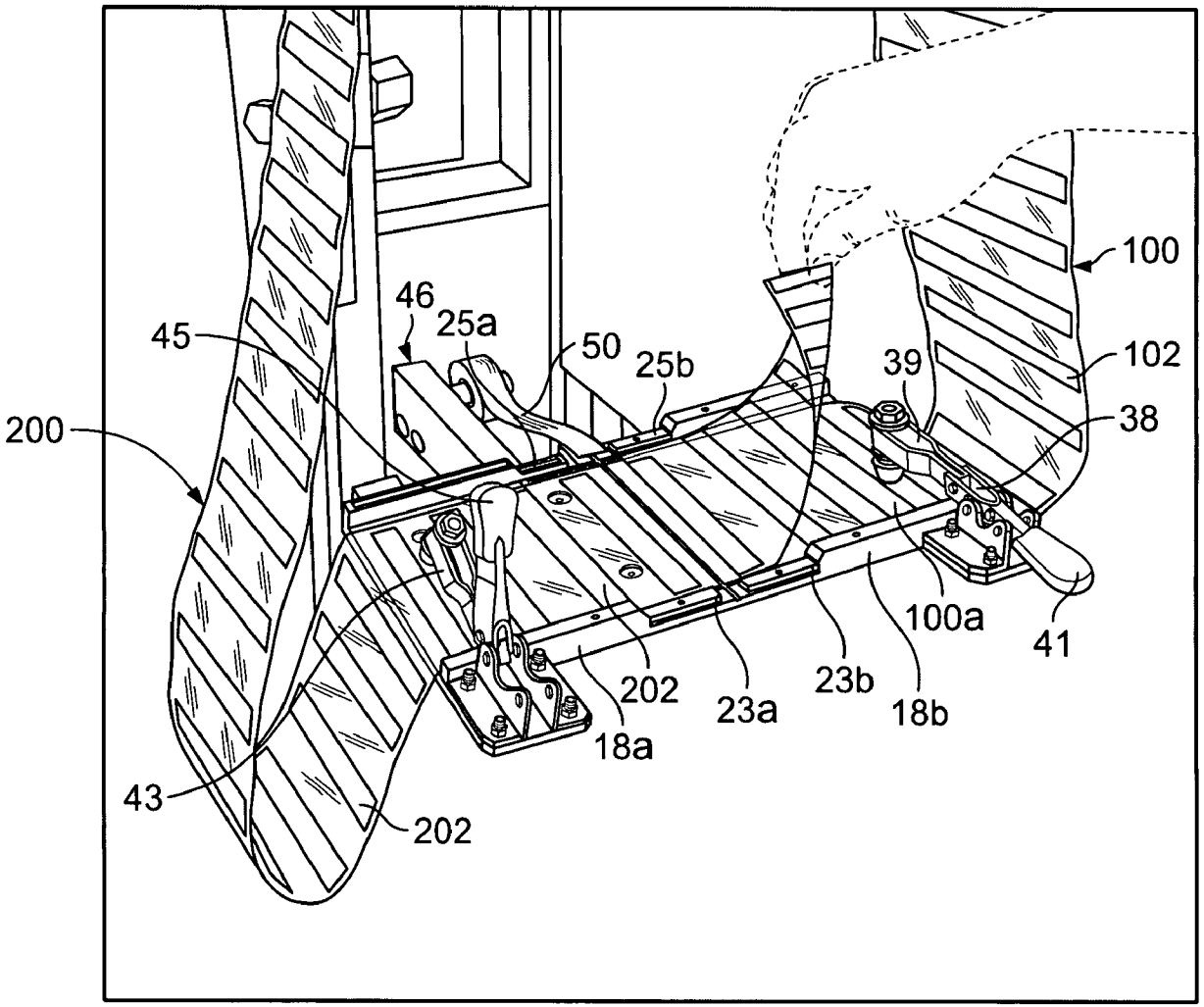
FIG. 10 is a perspective view of a sheet of labels from the replacement core being disposed on top of the cut sheet from the depleted core such that labels from both superimposed sheets are generally aligned.

After core 98 has been removed from shaft 99, a replacement core 198 may then be mounted on shaft 99, as best shown in FIG. 9. Replacement core 198 has a new supply sheet 200 which supports labels 202 that may be conveniently spaced apart at the same distance that labels 102 are spaced. As best shown in FIG. 10, a generous amount of sheet 200 is pulled from the replacement core 198 and is laid on top of sheet 100*a* so that labels 202 on sheet 200 are generally aligned with labels 102 on sheet 100*a*. Aligning labels 202 on sheet 200 with labels 102 on sheet 100*a* insures that the cutting groove 26 is not only under the sheet of material between a pair of labels 102-102, and not under any label 102, but also under the sheet of material between a pair of labels 202-202, and not under any label 202.

Figure 11:
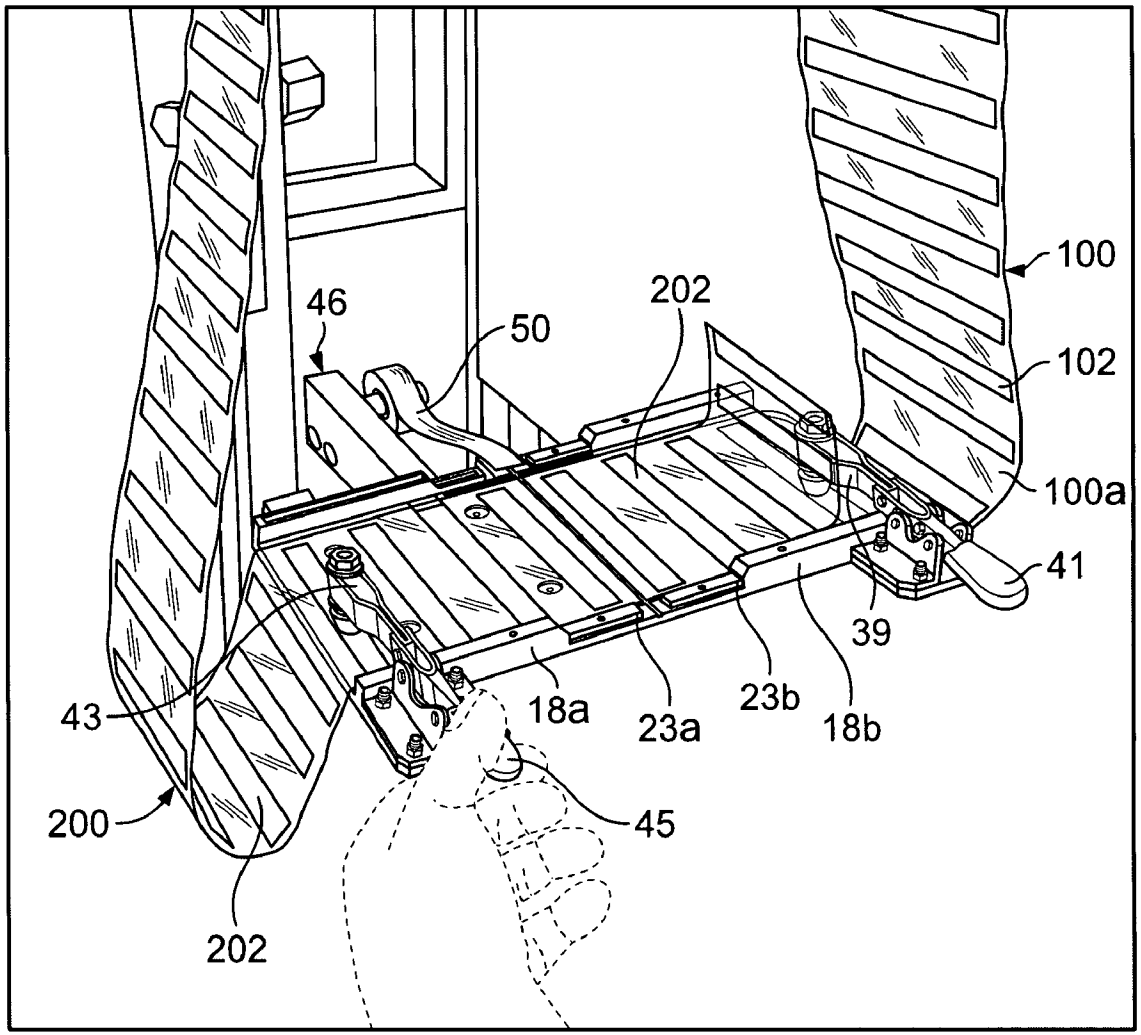
FIG. 11 is a perspective view after the sheet of labels from the replacement core has been disposed on top of the cut sheet such that the labels from both superimposed sheets are generally aligned and after the sheet of labels from the replacement core has been clamped against the top surface of the cut sheet from the depleted core.

After sheet 200 is pulled from the replacement core 198 and is laid on top of sheet 100*a* so that labels 202 on sheet 200 are generally aligned with labels 102 on sheet 100*a* (as best shown in FIG. 10), clamp assembly 42 is used to generally immobilize sheet 200 against the top surface of sheet 100*a*. Immobilizing or affixing the sheet 200 against the top surface of sheet 100*a* may be accomplished by lowering the clamping section 43 into contact with sheet 200, and then pivoting downwardly the locking handle 45, as best shown in FIG. 11, to lock the clamping section 43 into a posture which generally immobilizes sheet 200 against the top surface of sheet 100*a*, while labels 202 on sheet 200 remain generally aligned with labels 102 on sheet 100*a*.

Figure 12:
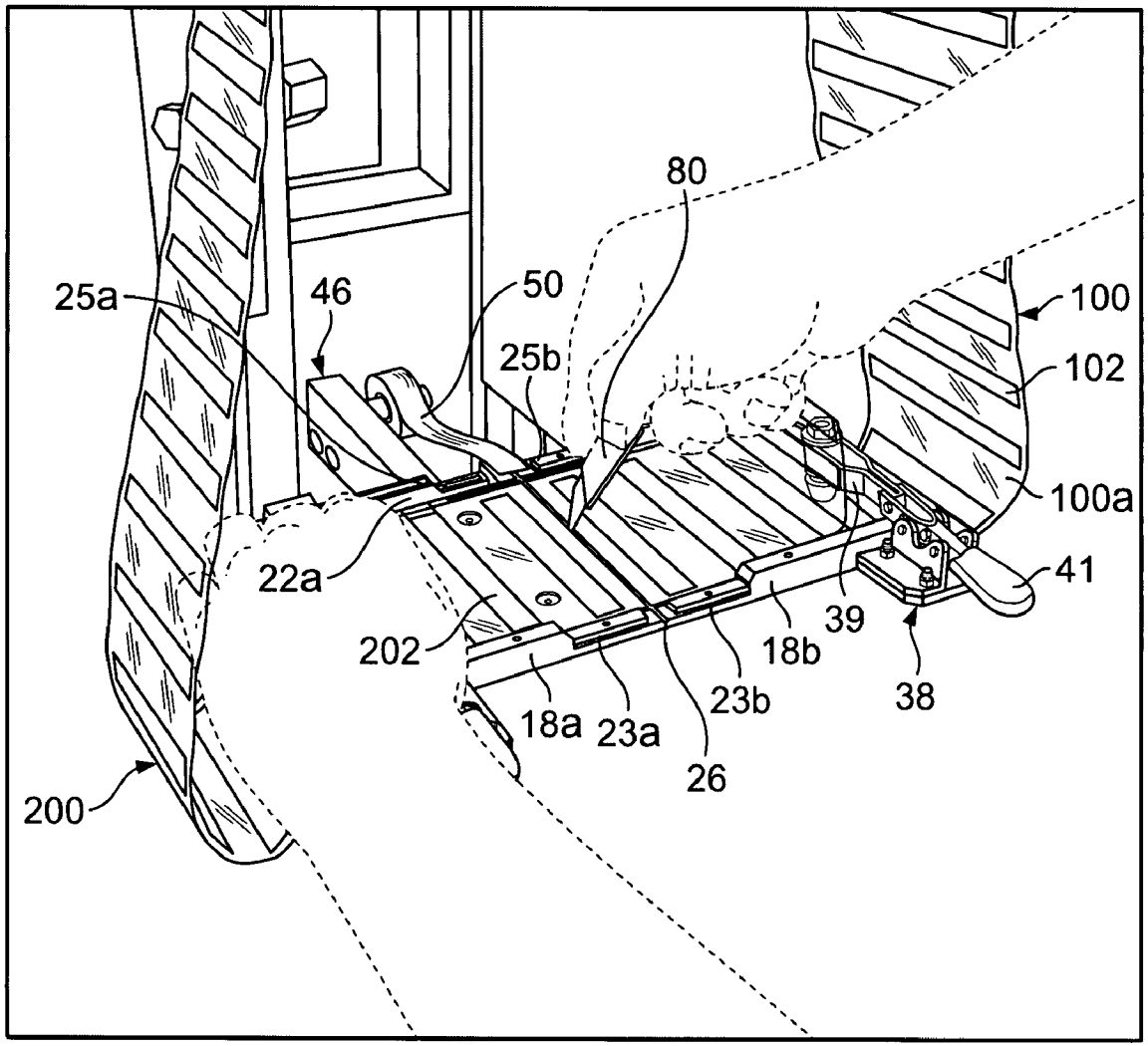
FIG. 12 is a perspective view of the superimposed sheets being cut by a knife passing along the through a cutting groove in the splice plate.
Figure 13:
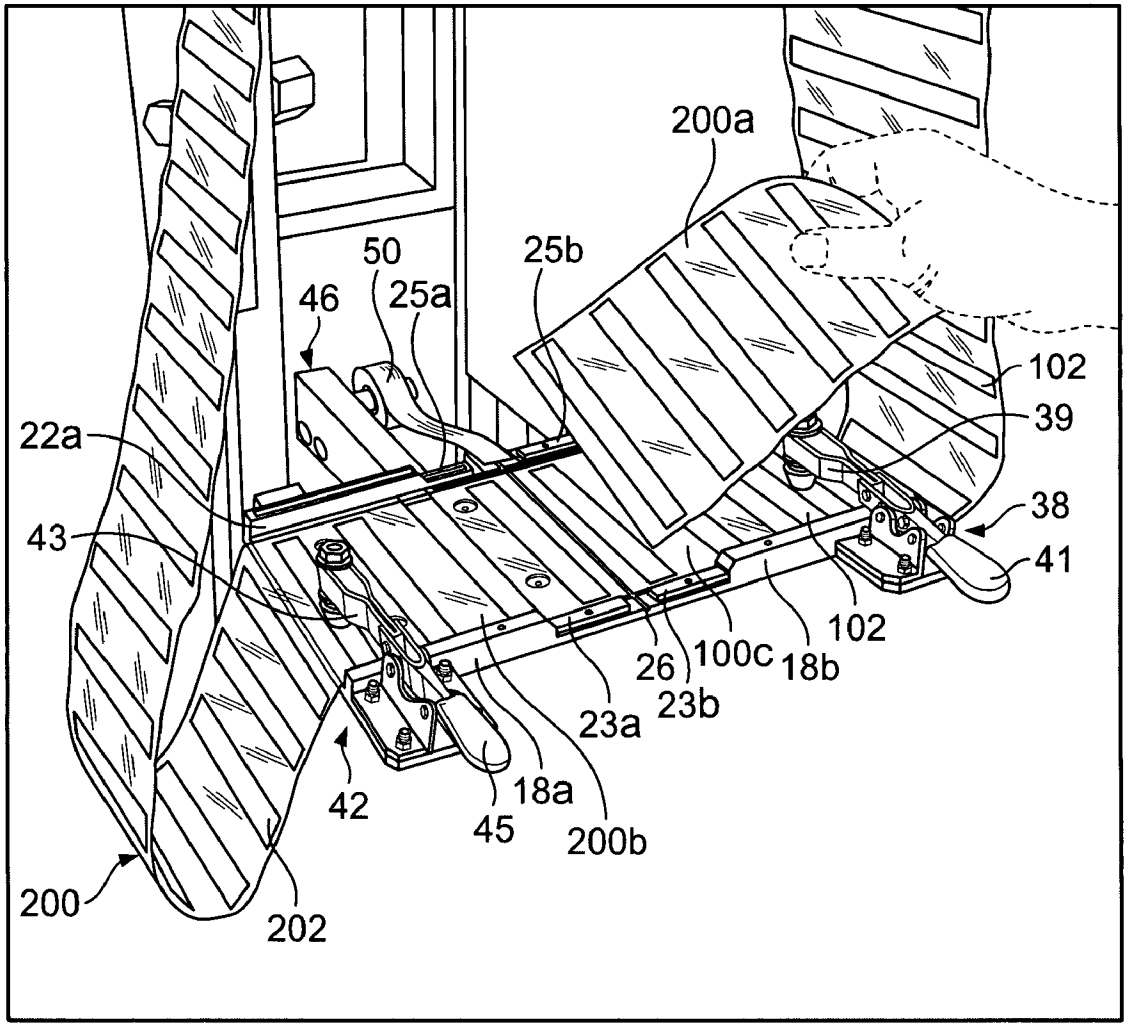
FIG. 13 is a perspective view after the superimposed sheets were cut with the knife and after a severed sheet from the sheet of labels from the replacement core is removed.
Figure 14:
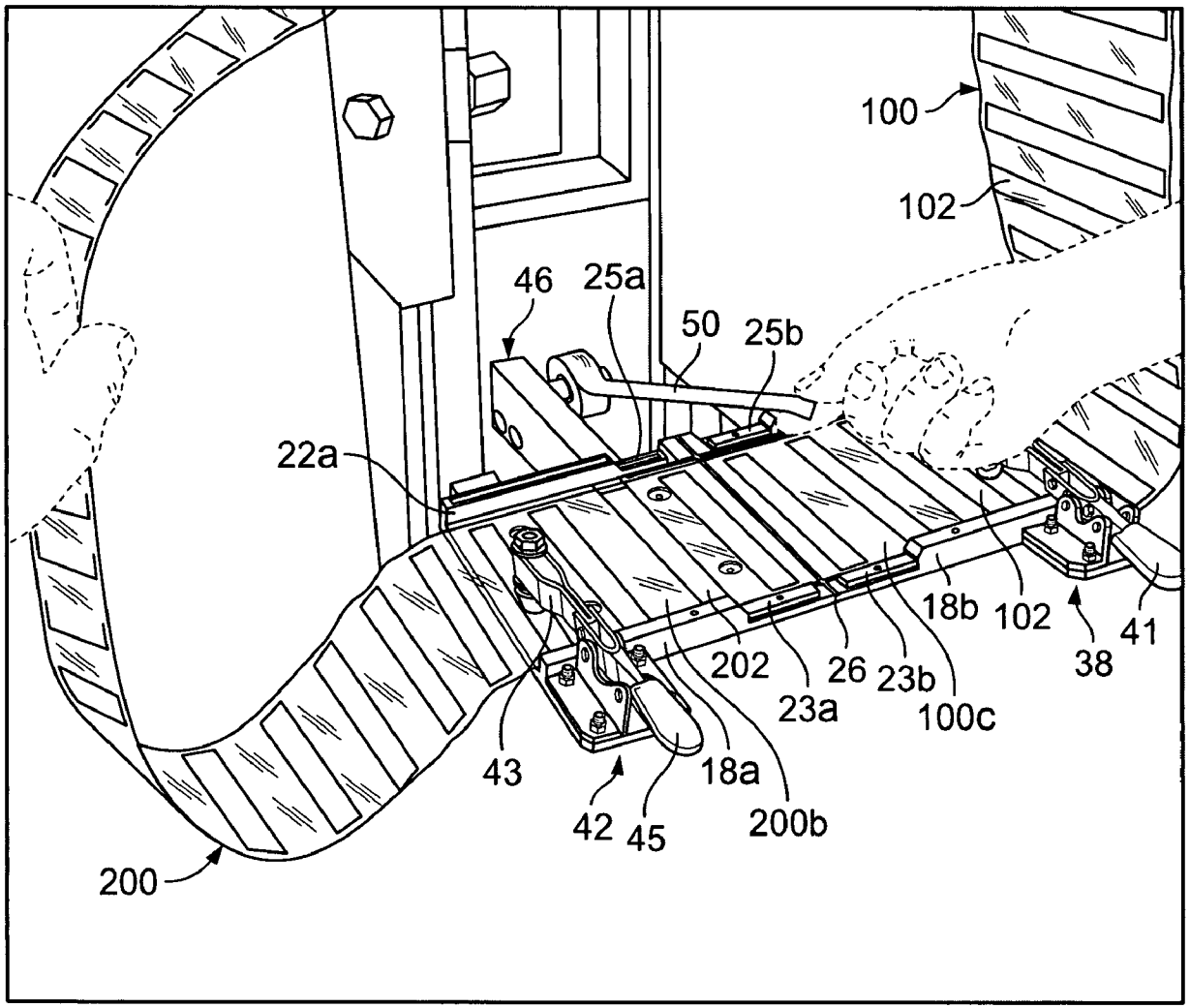
FIG. 14 is a perspective view of the splicing tape being pulled up and away from the roll of splice tape for splicing the two cut sheets of labels.
Figure 15:
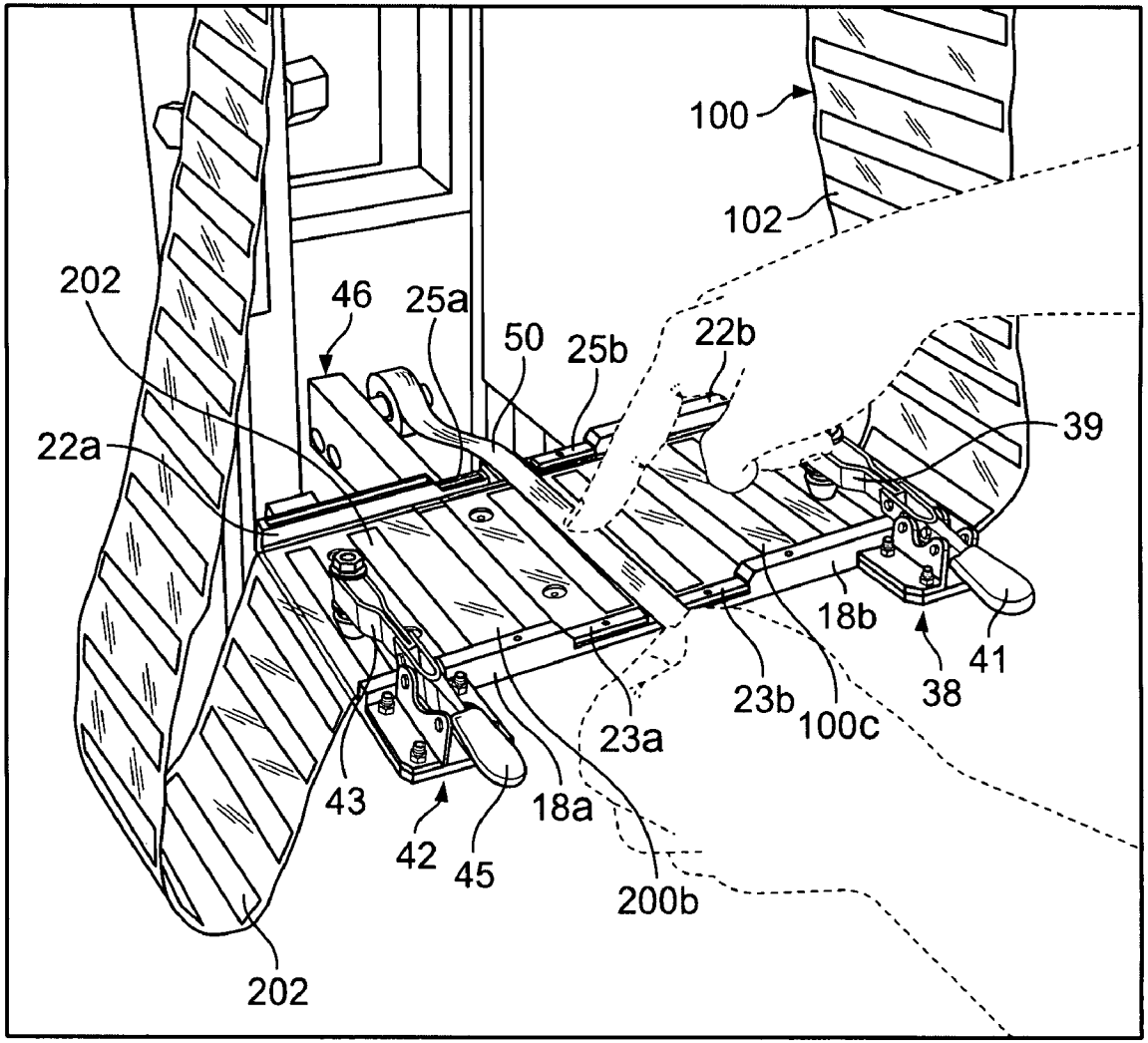
FIG. 15 is a perspective view of the splicing tape after being pulled up and away from the roll of splice tape and after being disposed on the two cut sheets of labels for splicing the sheets.

When sheets 202 and 100*a* have been superimposedly disposed on the splice plate 14 as indicated, the sheets 202 and 100*a* are cut or severed by inserting the knife 80 into an end of cutting groove 26 and subsequently transversely moving the knife 80 across the splice plate 14 and through the sheets 202 and 100*a* while the knife 80 remains in the cutting groove 26, as illustrated in FIG. 12. Thus, the cutting groove 26 is used as a guide to cut the superimposed sheets 202 and 100*a* between respective superimposed, aligned labels 202-202 and 102-102.

After the knife 80 has completely severed sheets 202 and 101*a*, a severed sheet 200*a* and a residual sheet 200*b* is produced along with a severed sheet 100*c* and residual sheet 100*d*. Severed sheet 200*a* is subsequently removed to expose residual sheet 100*c*. Removal of severed sheet 200*a* is facilitated by the fact that clamp assembly 38 has not engaged sheet 202. Residual sheet 200*b* may now be spliced to residual sheet 100*c*.

Figure 16:
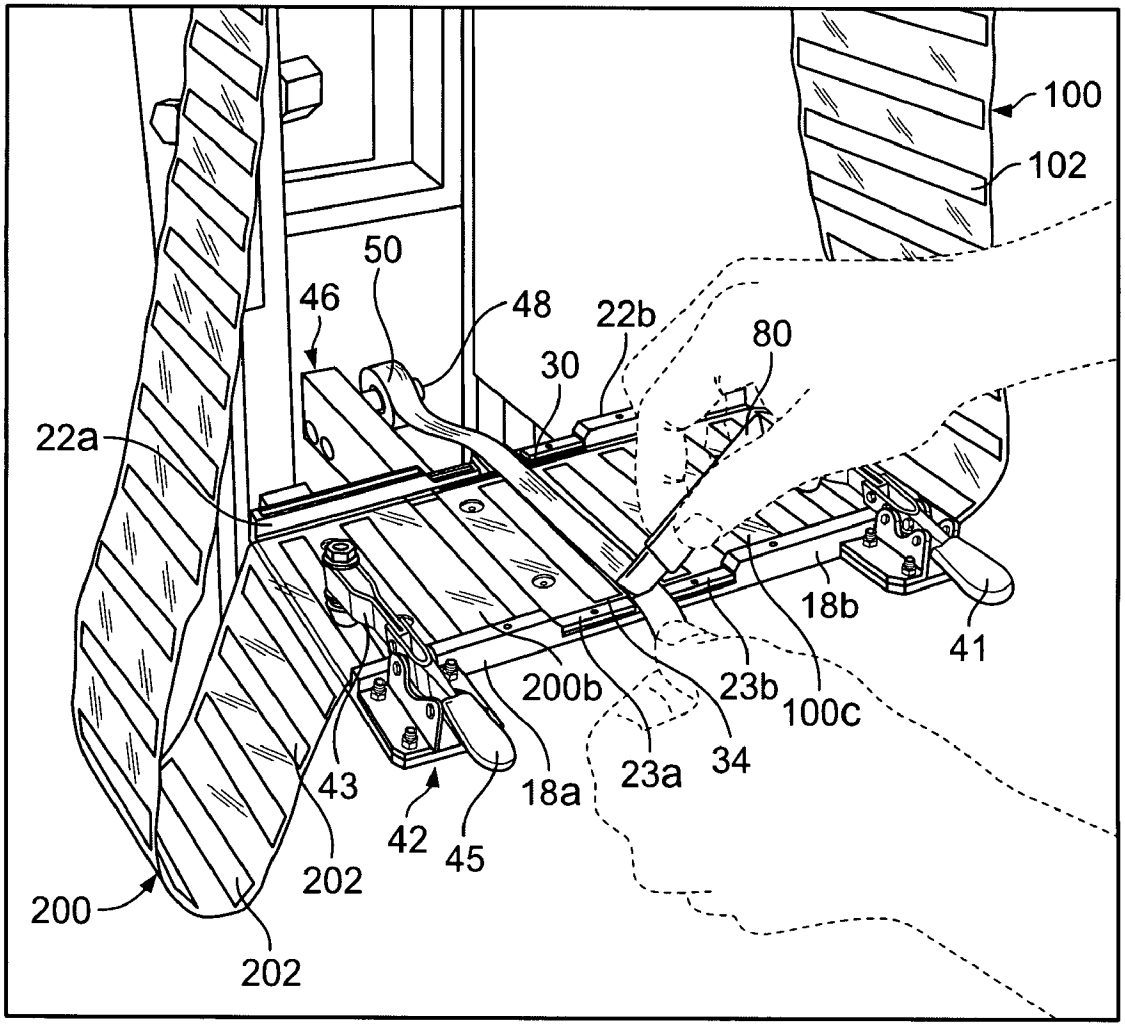
FIG. 16 is a perspective view of the splicing tape being transversely cut by a knife passing along and through a groove after the splice tape has been disposed on the two cut sheets of labels that are being spliced.
Figure 17:
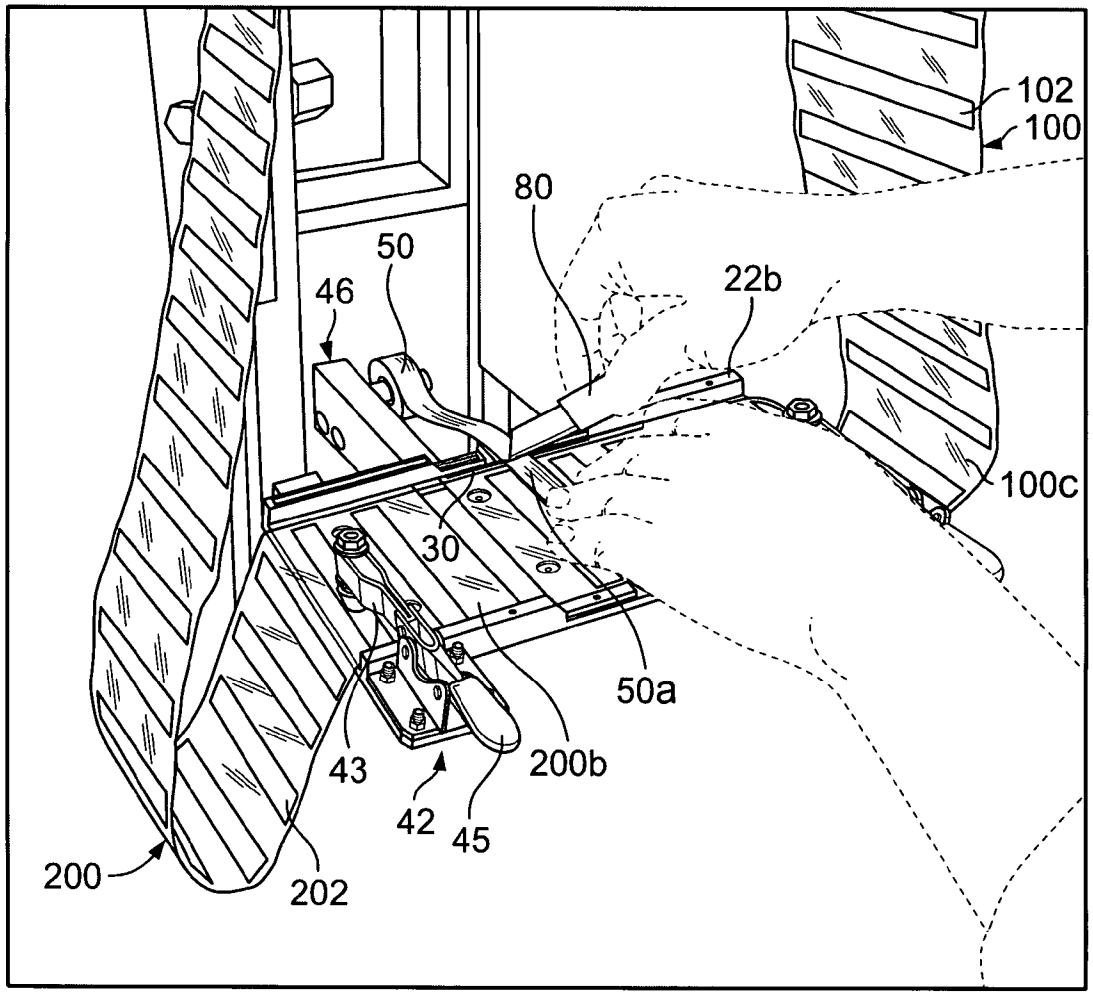
FIG. 17 is a perspective view of the splicing tape being transversely cut by a knife at another part of the disposed splicing tape by the knife passing along and through a groove in the splice tape.

Splicing of residual sheet 200*b* to residual sheet 100*c* comprises gripping the splicing tape 50 and raising the splicing tape 50 upwardly as it is being pulled out. After a sufficient amount of splicing tape 50 has been pulled out, it is brought straight downwardly between tape guides 25*a*, 25*b* and 23*a*, 23*b*, and over cut sections and between labels 202 and 102 of the respective residual sheets 200*b* and 100*c*. The splicing tape 50 is subsequently cut, as best shown in FIG. 17, by inserting the knife 80 into cutting groove 30 and subsequently moving the knife 80 through the splicing tape 50 transversely while remaining in the cutting groove 30. The other end of the splicing tape 50 is similarly cut; that is, knife 80 is inserted into cutting groove 34 and subsequently moved through the splicing tape 50 transversely while remaining in the cutting groove 34, as shown in FIG. 16. After splicing tape 50 has been cut twice, severed splice tape 50*a* is produced and is the coupling medium for having spliced together residual sheet 200*b* and residual sheet 100*c*.

Figure 18:
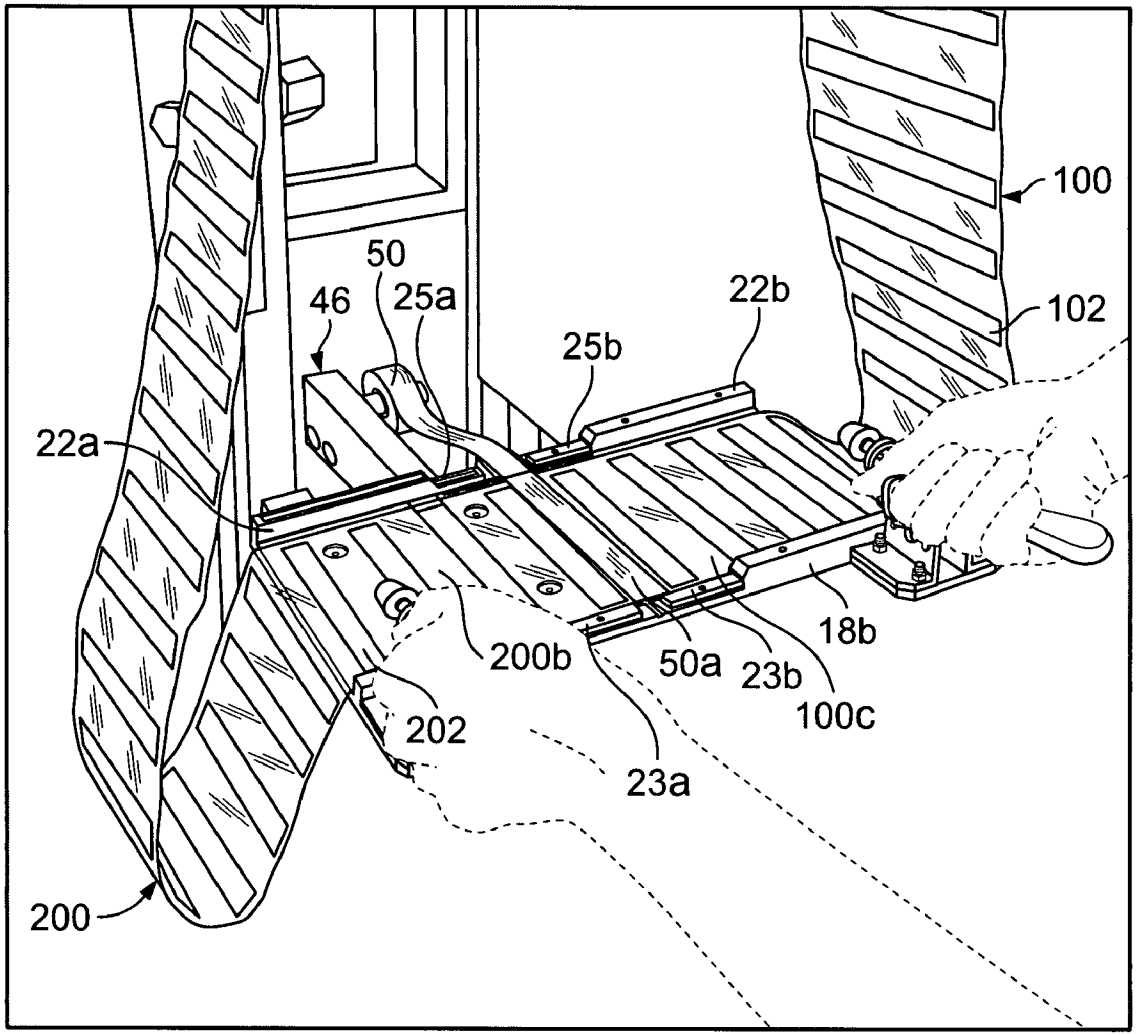
FIG. 18 is a perspective view of the two clamping assemblies being released from and off of the two spliced sheets of labels.
Figure 19:
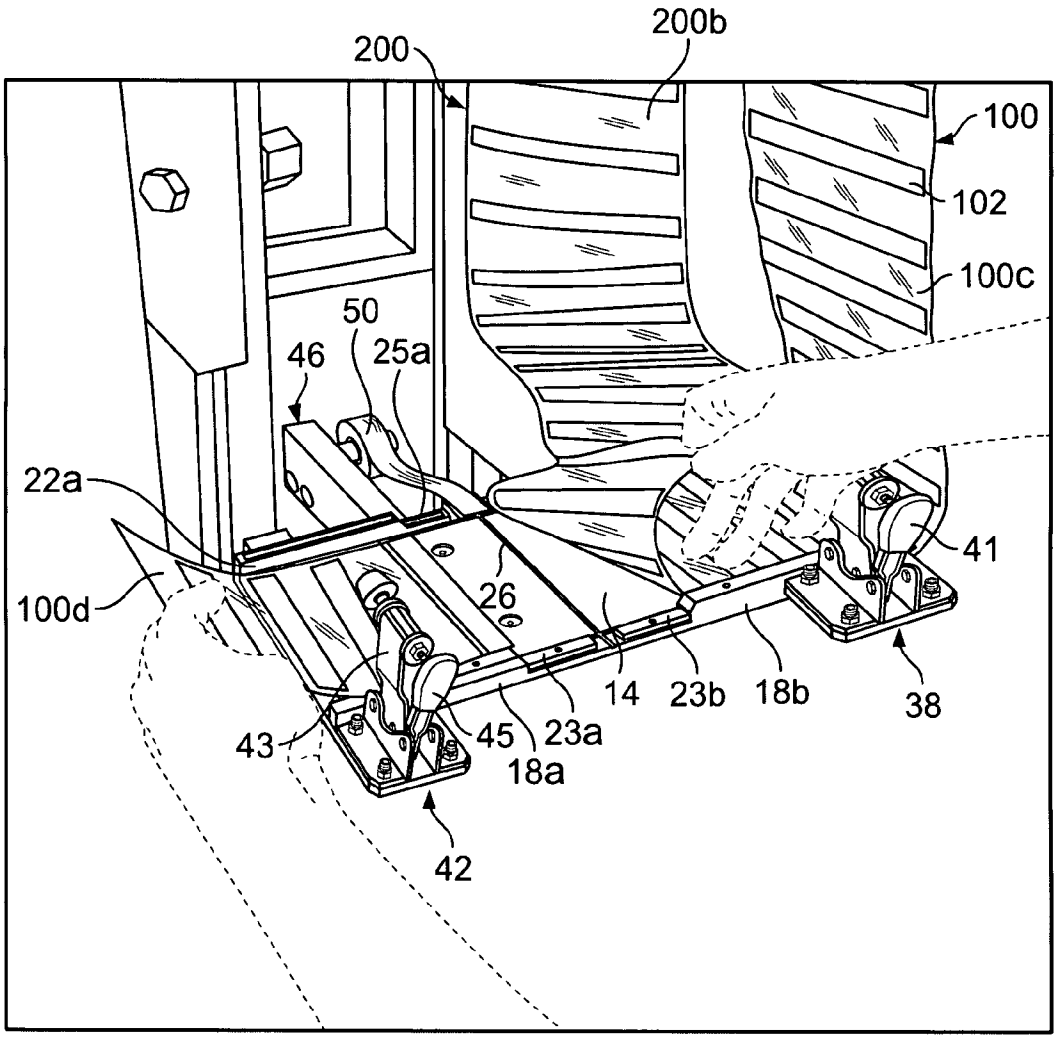
FIG. 19 is a perspective view after the two clamping assemblies have been released from and off of the two spliced sheets of labels, and with a severed sheet from the cut sheet from the depleted core being removed off of the splice plate.

After the splicing tape 50 has been placed between tape guides 23*a*, 23*b* and 25*a*, 25*b*, and across and over edges of the cut sections (and between contiguous spaced labels 202 and 102) of the respective residual sheets 200*b* and 100*c*, and subsequently cut as indicated, the cut edges of the splicing tape 50 generally registers with the opposed sides of residual sheets 200*b* and 100*c*. Subsequently and as illustrated in FIG. 18, clamping assemblies 38 and 42 are respectively disengaged from residual sheets 100*c* and 200*b*. Clamp assembly 38 is disengaged from residual sheet 110*c* by pivoting locking handle 41 upwardly to release the clamping section 39 off of the surface of residual sheet 110*c*. Similarly, clamp assembly 42 is disengaged from residual sheet 200*b* by pivoting locking handle 45 upwardly to release the clamping section 43 off of the surface of residual sheet 200*b*. The severed sheet 100*d* may now be discarded, as illustrated in FIG. 19, since it too has been released from a generally immobilized posture by the releasing of clamp assembly 42.

Figure 20:
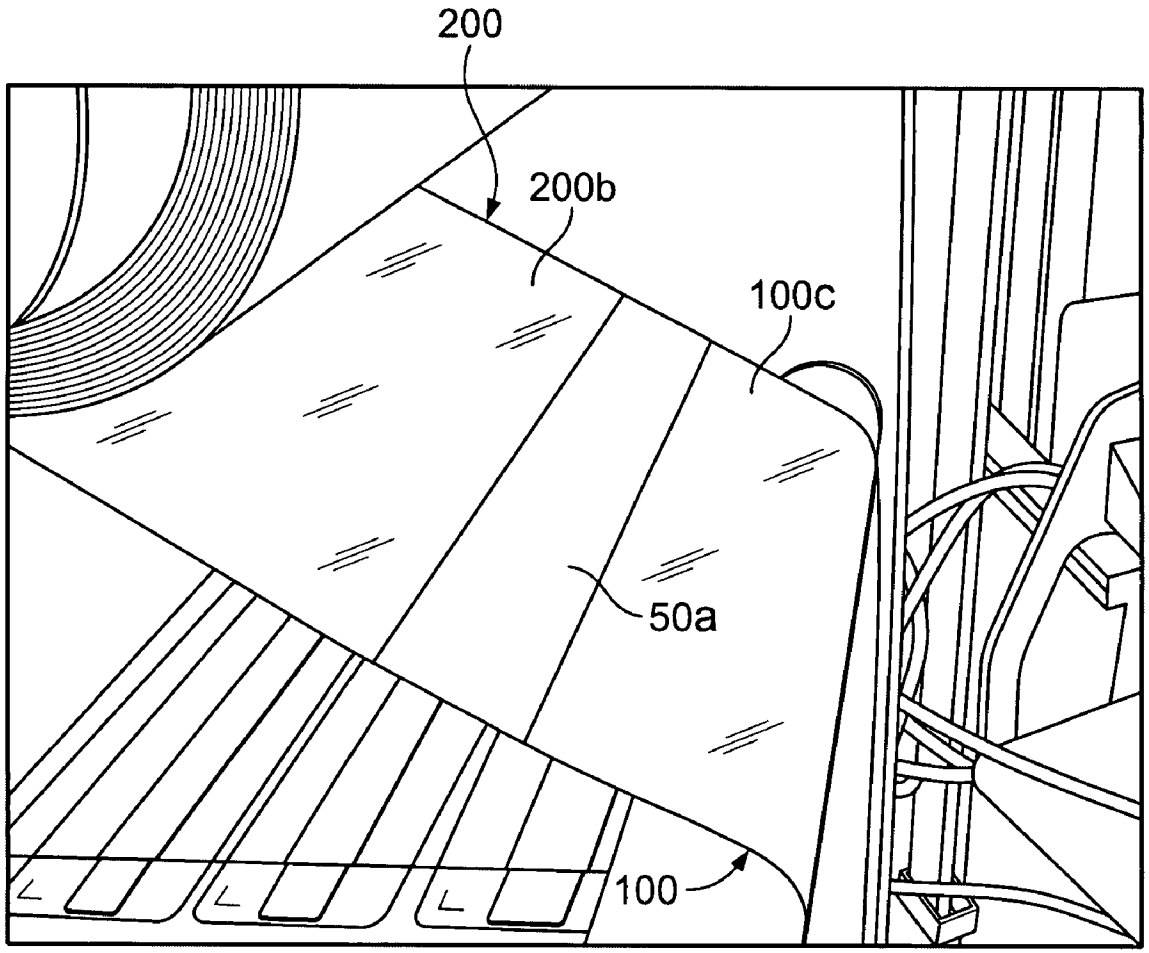
FIG. 20 a perspective view of the two spliced sheets of labels.

Replacement roll or core 198 may now be rotated to take up the slack in the two spliced sheets, i.e., residual sheets 200*b* and 100*c*. Referring now to FIG. 20, there is seen the results of the splicing procedure, with severed splice tape 50*a* firmly holding or coupling together residual sheets 200*b* and 100*c*. Labeler 60 may be restarted again after all alarms have been reset.

By practice of various embodiments of the invention, the splice plate assembly 10 allows the splice to be located such that the labeler 60 does not error or miss labels. If one attempts to manually splice sheets, the resulting splice typically causes a labeler (such as labeler 60) to miss cases and will many times the resulting manual splice-will cause the labeler to jam.

Reference throughout this specification to "one embodiment", "an embodiment", or "a specific embodiment" means that a particular feature, structure, or characteristic described in connection with the embodiment is included in at least one embodiment of the present invention and not necessarily in all its embodiments. Therefore, the respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any arrows in the drawings/figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of the illustrated embodiments of the present invention and are to be included within the spirit and scope of the present invention.

Therefore, while the present invention has been described herein with reference to the particular embodiments thereof, a latitude of modification, various changes and substitutions are intended in the foregoing disclosures, and it will be appreciated that in some instances some features of the embodiments of the invention will be employed without the corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A method for installing a roll of labels on a labeler, the method comprising:

removing from a labeler a first core having a generally winding first sheet which supports a plurality of first labels;

positioning the first sheet on a support surface;

positioning on the labeler a second core having a generally winding second sheet which supports a plurality of second labels;

disposing the second sheet on the first sheet;

cutting the first sheet and the second sheet to provide a severed second sheet, a residual second sheet, a severed first sheet, and a residual first sheet, wherein the cutting of the first sheet and the second sheet comprises passing a knife member through a first groove in the support surface;

removing the severed second sheet to expose the residual first sheet;

positioning a splicing tape over cut portions of the first sheet and the second sheet and between a first pair of tape guides and a second pair of tape guides, and wherein tape guides of each pair are spaced at a distance that is substantially equal to a width of the splicing tape;

coupling the residual second sheet to the residual first sheet by disposing the splicing tape on top of the residual second sheet and on top of the residual first sheet; and cutting the splicing tape, wherein cutting of the splicing tape comprises passing the knife member through a second groove and a third groove in the support surface, wherein the first groove intersects with the second groove and the third groove forming two intersections, wherein the two intersections are spaced from each other at a first distance, and wherein the first pair of tape guides are spaced from the second pair of tape guides at a second distance, wherein the second distance is longer than the first distance.

2. The method of claim 1 additionally comprising aligning one of the first labels with a label-positioning indicia on the support surface.

3. The method of claim 1 additionally comprising generally immobilizing the first sheet against the support surface.

4. The method of claim 1 wherein the tape guides are raised above the first groove and have a top surface that is substantially flat.

5. The method of claim 1 wherein said cutting the second sheet and the first sheet comprises cutting the second sheet between a pair of second labels and cutting the first sheet between a pair of first labels.

6. The method of claim 2 wherein said label-positioning indicia generally has the same configuration as the first label which is being aligned with the label-positioning indicia.

7. The method of claim 2 wherein said label-positioning indicia and said first label generally being aligned therewith have different colors.

8. The method of claim 1 wherein said coupling the second sheet to the first sheet comprises superimposing the splicing tape on a portion of the second sheet and the first sheet.

9. The method of claim 1 additionally comprising cutting the first sheet before removing the first core from the labeler.

10. A method for splicing, the method comprising:

providing a first pliable substrate which supports a plurality of first members;

providing a second pliable substrate which supports a plurality of second members;

superimposedly disposing the second pliable substrate on the first pliable substrate;

severing the first pliable substrate and the second pliable substrate to respectively produce a residual second pliable substrate and a severed second pliable substrate, and a residual first pliable substrate and a severed first pliable substrate, wherein the severing of the first pliable substrate and the second pliable substrate comprises passing a knife member through a first groove in a support surface;

removing the severed second pliable substrate to expose the residual first pliable substrate;

positioning a splicing tape over cut portions of the first sheet and the second sheet and between a first pair of tape guides and a second pair of tape guides, wherein tape guides of each pair are spaced at a distance that is substantially equal to a width of the splicing tape;

splicing the residual second pliable substrate to the residual first pliable substrate by disposing the splicing tape on top of the residual second pliable substrate and on top of the residual first pliable substrate; and severing the splicing tape, wherein severing of the splicing tape comprises passing the knife member through a second groove and a third groove in the support surface, wherein the first groove intersects with the second groove and the third groove forming two intersections, wherein the two intersections are spaced from each other at a first distance, and wherein the first pair of tape guides are spaced from the second pair of tape guides at a second distance, wherein the second distance is longer than the first distance.

11. The method of claim 10 additionally comprising removing the severed first pliable substrate.

12. The method of claim 10 wherein said first and second members respectively comprise first and second labels.

13. The method of claim 10 additionally comprising cutting the splicing tape at least once in a cutting direction which is generally normal to the cutting direction of said severing.

14. A splicing assembly comprising:

a splicing plate having a structure defining a first cutting groove, a second cutting grove, and a third cutting groove, wherein the first cutting groove intersects with the second cutting groove and the third cutting groove forming two intersections, wherein the two intersections are spaced from each other at a first distance;

a positioning marker disposed on said splicing plate; and at least one clamping assembly coupled to said splicing plate; and a first pair of tape guides and a second pair of tape guides for facilitating disposition of a splicing tape on top of a first sheet and on top of a second sheet, wherein tape guides of each pair are spaced at a distance that is substantially equal to a width of the splicing tape, and wherein the first pair of tape guides are spaced from the second pair of tape guides at a second distance, wherein the second distance is longer than the first distance.

15. The splicing assembly of claim 14 wherein the first cutting groove facilitates cutting the first and second sheets, and wherein the second and third cutting grooves facilitate cutting the splicing tape.

* * * * *